US005720280A

United States Patent [19]

Elstran et al.

[11] Patent Number: 5,720,280

[45] Date of Patent: Feb. 24, 1998

[54] ATTENUATOR FOR USE WITH RESPIRATORS

[75] Inventors: Gerald V. Elstran, Woonsocket, S. Dak.; Robert J. Mattila, Mahtomedi; Jerome D. Phillips, Wyoming, both of Minn.

[73] Assignee: Minnesota Mining and Manufacturing Company, St. Paul, Minn.

[21] Appl. No.: 728,277

[22] Filed: Oct. 8, 1996

Related U.S. Application Data

[62] Division of Ser. No. 434,377, May 3, 1995, Pat. No. 5,592,935.

[51] Int. Cl.[6] ..... A62B 7/00

[52] U.S. Cl. ..... 128/205.25; 128/200.24; 128/201.23; 128/204.18; 128/206.12; 128/206.21; 128/206.28

[58] Field of Search ..... 128/200.24, 201.23, 128/201.25, 201.28, 204.18, 205.12, 205.24, 205.25, 205.27, 205.29, 206.12, 206.15, 206.17, 206.21, 206.28, 207.12

[56] References Cited

U.S. PATENT DOCUMENTS

| | | | |
|---|---|---|---|
| 2,348,277 | 5/1944 | Boothby et al. | 128/201 |
| 2,438,058 | 3/1948 | Kincheloe | 128/205.12 |
| 2,775,968 | 1/1957 | Polli et al. | 128/205 |
| 3,202,150 | 8/1965 | Miller | 128/205 |
| 4,233,972 | 11/1980 | Hauff et al. | 128/205 |
| 4,331,141 | 5/1982 | Pokhis | 128/204 |
| 4,433,684 | 2/1984 | Sarnoff et al. | 128/203.12 |
| 4,494,538 | 1/1985 | Ansite | 128/205.25 |
| 4,502,480 | 3/1985 | Yamamoto | 128/201 |
| 4,522,639 | 6/1985 | Ansite et al. | 55/314 |
| 4,537,748 | 8/1985 | Billiet | 128/202 X |
| 4,590,951 | 5/1986 | O'Connor | 128/204 |
| 4,625,721 | 12/1986 | Levine | 128/201.28 |
| 4,646,732 | 3/1987 | Chien | 128/205 |
| 4,653,493 | 3/1987 | Hoppough | 128/202 |
| 4,674,492 | 6/1987 | Niemeyer | 128/202.22 |
| 4,850,346 | 7/1989 | Michel et al. | 128/206 |
| 4,886,056 | 12/1989 | Simpson | 128/201 |
| 4,991,577 | 2/1991 | Shigematsu | 128/207 |
| 5,007,421 | 4/1991 | Stewart | 128/204 |
| 5,054,481 | 10/1991 | Shin | 128/205.12 |
| 5,062,421 | 11/1991 | Burns et al. | 128/205 |
| 5,086,768 | 2/1992 | Niemeyer | 128/205 |
| 5,303,701 | 4/1994 | Heins et al. | 128/206 |
| 5,318,019 | 6/1994 | Celaya | 128/204 |
| 5,318,020 | 6/1994 | Schegerin | 128/205 |
| 5,394,867 | 3/1995 | Swann | 128/201.25 |

FOREIGN PATENT DOCUMENTS

| | | | |
|---|---|---|---|
| 1 222 377 | 8/1966 | Germany | 128/205.12 |

*Primary Examiner*—Vincent Millin
*Assistant Examiner*—William J. Deane, Jr.
*Attorney, Agent, or Firm*—James A. Rogers

[57] ABSTRACT

A positive/negative air pressure adaptor for a respirator system. The positive/negative air pressure adaptor has a port region for fluidically coupling a filter cartridge to a respirator. The adaptor has an inlet port for connecting to a positive pressure air source and a first check valve to restrict the flow of air from the port region to the filter cartridge. A second check valve may be provided to restrict the flow of air from the respirator to the port region. When the positive pressure air source is disconnected, the respirator system operates as a negative pressure respirator.

6 Claims, 11 Drawing Sheets

ATTENUATOR FOR USE WITH RESPIRATORS

This is a division of patent application Ser. No. 08/434,377 filed May 3, 1995 now U.S. Pat. No. 5,592,935.

FIELD OF THE INVENTION

The present invention relates to a combination positive and negative pressure respirator system, and more particularly, to a positive/negative air pressure adaptor for use with respirator systems.

BACKGROUND OF THE INVENTION

Respirators are used in a variety of hazardous enviornments, such as paint booths, grain storage facilities, laboratories, and manufacturing facilities in which contaminants are present. Respirator masks are typically adapted to receive a variety of filter cartridges or air supply connectors to provide a source of breathable air to the wearer so that the same face mask design may be used in a variety of different hazardous environments.

The two major classes of respirator systems are positive and negative pressure respirators. A positive pressure respirator typically includes a positive pressure air source such as an external pump or pressurized vessel that force clean air into the face mask. The positive pressure air source provides an excess of clean, breathable air to a face mask. The net positive pressure in the face mask due to the positive pressure air source prevents ambient air from being drawn around the face seal of the mask.

One type of positive pressure air source for use with a positive pressure respirator system is a powered air purifier respirator (PAPR). A powered air purifying respirator typically includes a breathing tube from the face mask to a battery powered blower unit worn by the user. The blower unit typically contains a filter to remove contaminants from the ambient air. Powered air purifying respirators have the advantage of allowing the user to move freely, without being tethered to an air line. However, powered air purifying respirators tend to be more expensive than continuous flow respirator systems. Additionally, powered air purifying respirators are battery operated and consequently can only be used for a limited period of time. Finally, powered air purifying respirators generally require a large bore diameter breathing tube (approximately 25 mm), because battery operated blowers generally can not generate sufficient pressure for a smaller bore diameter breathing tube. These large bore diameter breathing tubes can be cumbersome to the user.

Alternatively, the positive pressure air source may be a compressor or pressure vessel connected to the user by an air line. Typically, these systems include a filter at the compressor to provide the user with breathable air. However, for some applications, the air line may restrict the user's ability to perform certain functions. Additionally, the air line may get kinked or the supply of pressurized air may be accidentally terminated, potentially exposing the users to contaminants.

The other major class of respirators are called negative pressure respirators because the user's inhalation draws air through a filter cartridge into the face mask. The filter cartridge may contain a variety of filtering elements, such as blown microfibers or carbon-based systems for gas and vapor protection. Negative pressure respirators have the advantage of not requiring the wearer to drag an air line or to wear an expensive powered-air purifying respirator system. The disadvantage of negative pressure respirators is that the user must utilize lung power to draw air through the filter media and the resulting negative pressure in the face mask can potentially allow contaminants to be drawn in around the face seal. Additionally, using respiratory lung power to draw air through the filter media tends to heat up the face mask, creating discomfort for the wearer. Consequently, negative pressure respirators generally have a lower protection level than positive pressure respirators.

SUMMARY OF THE INVENTION

The present invention is directed to an air pressure adaptor for fluidly coupling a positive pressure air source to a portable respirator worn by a user. The air pressure adaptor comprises an adaptor housing directly connectable to the respirator. The adaptor housing has an inlet port fluidly coupled to a port region within the adaptor housing. The inlet port is connectable to the positive pressure air source and the port region is fluidly connectable to the respirator. A porous structure is interposed between the inlet port and the port region, whereby the porous structure is capable of permitting compressed air to flow from the inlet port to the port region while attenuating air line noise.

The present invention is also directed to a portable respirator system worn by a user for use with a positive pressure air source. The respirator system comprises a face mask having an exhaust port and at least one inhalation port. The present adaptor housing is fluidly connectable to the inhalation port.

The porous structure may be selected from a group consisting of sintered metal, porous polypropylene, porous polyethylene, porous acetal, porous ceramic or a porous glass bead structure. The porous structure is capable of directing compressed air from the positive pressure air source radially into the port region.

Definitions used in this application:

"Ambient air" means environmental air;

"Check valve" means any device for automatically limiting flow to a single direction.

"Contaminant" means a chemical in gaseous, vaporous, or particulate form that is hazardous to breath.

"External environment" means ambient air external to the respirator;

"Face mask" means a full or partial face covering with a seal engaged with the face, neck and/or head of a user.

"Overmolding" means performing a molding process on an item to add additional molded structure.

"Positive pressure air source" means a device that forces breathable air to a respirator, including a portable air pump, such as a powered air purifying respirator (PAPR), a stationary air pump or compressor, or pressurized vessel.

DETAILED DESCRIPTION OF THE PREFERRED EMBODIMENT

Figure 1:
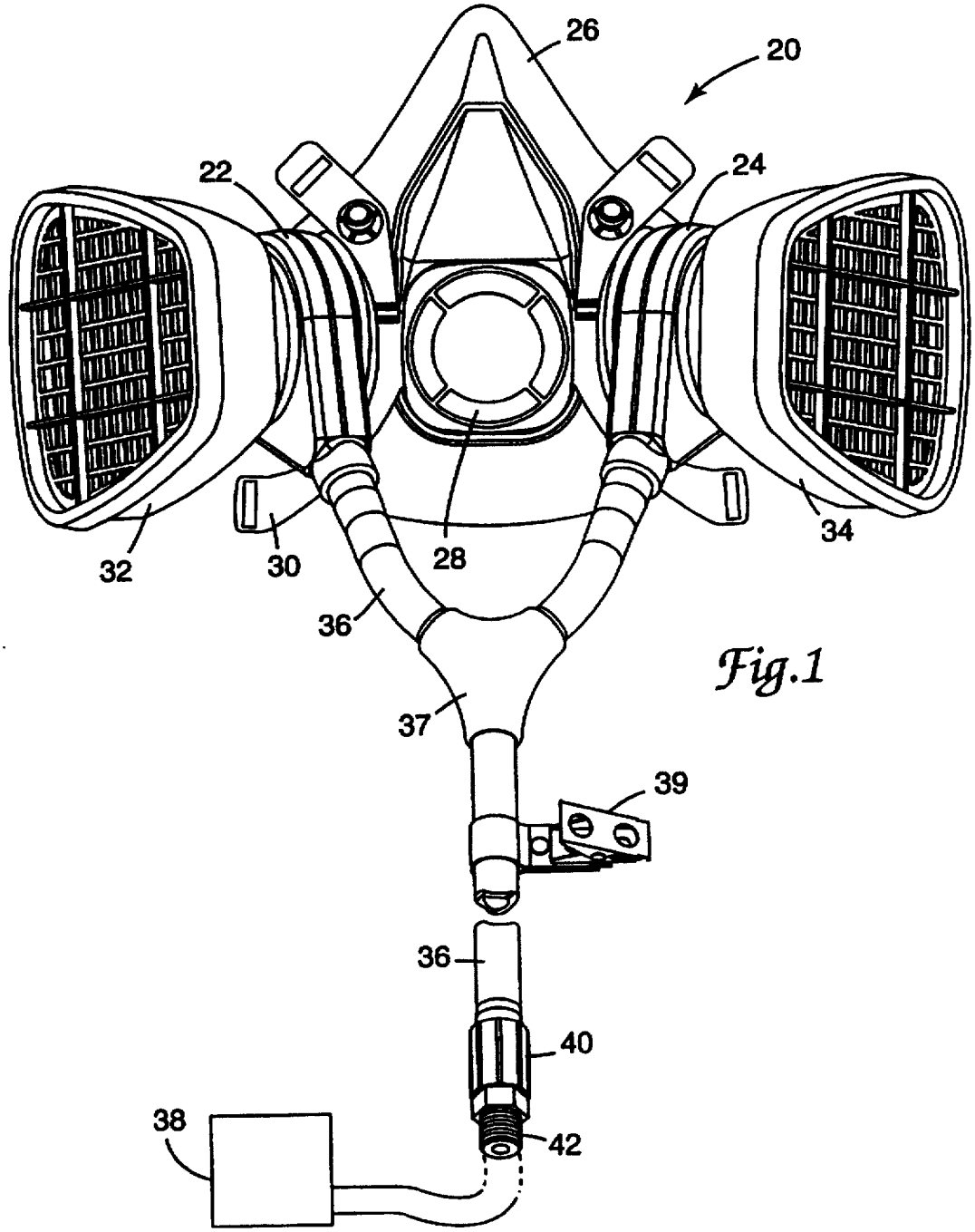
FIG. 1 is a schematic illustration of a respirator system with a positive/negative air pressure adaptor connected to a positive pressure air source.

FIG. 1 is a perspective view of a combination positive and negative pressure respirator system 20. A pair of positive/negative air pressure adapters 22, 24 are connected to a partial face mask 26 at respective inhalation ports (see FIG. 4). The face mask 26 has an exhaust port 28 with a check valve (not shown) and straps 30 for attachment to a user. The partial face mask 26 generally encloses the user's mouth and nose. It will be understood that the present invention may be used with any style face mask.

A pair of filter cartridges 32, 34 are attached to the adapters 22, 24, respectively. An air line 36 with a Y-connector 37 connects the adapters 22, 24 with a positive pressure air source 38. Utilizing a pair of adapters 22, 24 and filter cartridges 32, 34 keeps the respirator 20 generally evenly balanced. However, it will be understood that the present invention encompasses a respirator system with a single adaptor and filter cartridge.

A check valve 40 and a quick release mechanism 42 are provided on the air line 36 to allow the user to quickly disconnect from the positive pressure air source 38. The check valve 40 prevents ambient air from being drawn into the face mask 26 once air line 36 is disconnected from the positive pressure air source 38. It will be understood that the check valve 40 may be located anywhere along the air line 36 between the quick release mechanism 42 and the respirator system 20. A check valve known under the trade designation ICV Series from Generant Company of Butler, N.J., is known to be suitable for this purpose. The air line 36 or check valve 40 may contain a low pressure alarm to warn the user that the air flow from the positive pressure air source 38 has been reduced below some predetermined level and that the filter cartridge 32, 34 is providing at least a portion of their air.

Figure 2:
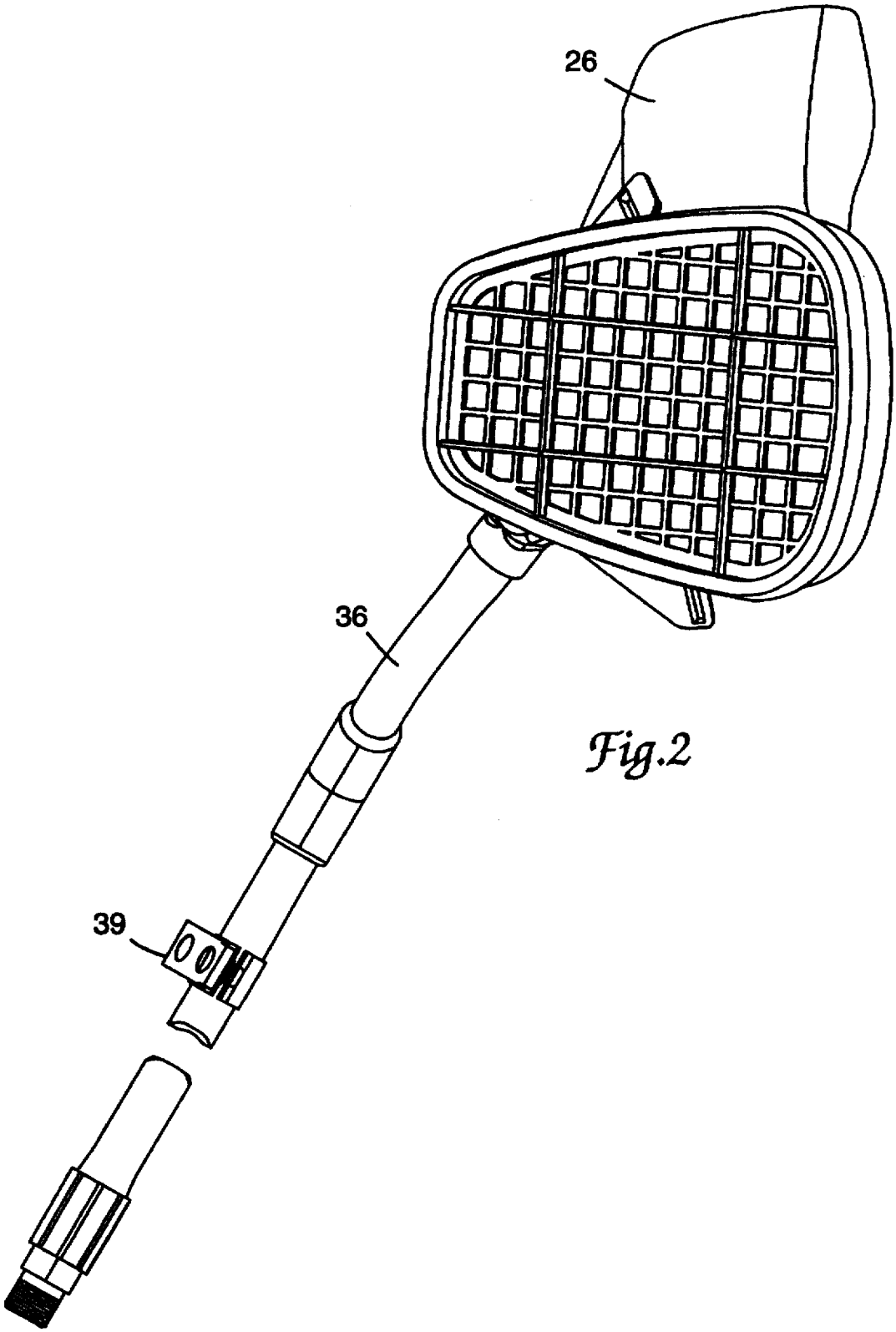
FIG. 2 is a side view of the respirator of FIG. 1.

FIG. 2 is a side view of the respirator system 20 of FIG. 1 showing the air line 36 extending forward from the face mask 26. A belt clip 39 is provided for attaching the air line 36 to the user so that the respirator system 20 is not inadvertently pulled from the user's face (not shown).

Figure 3:
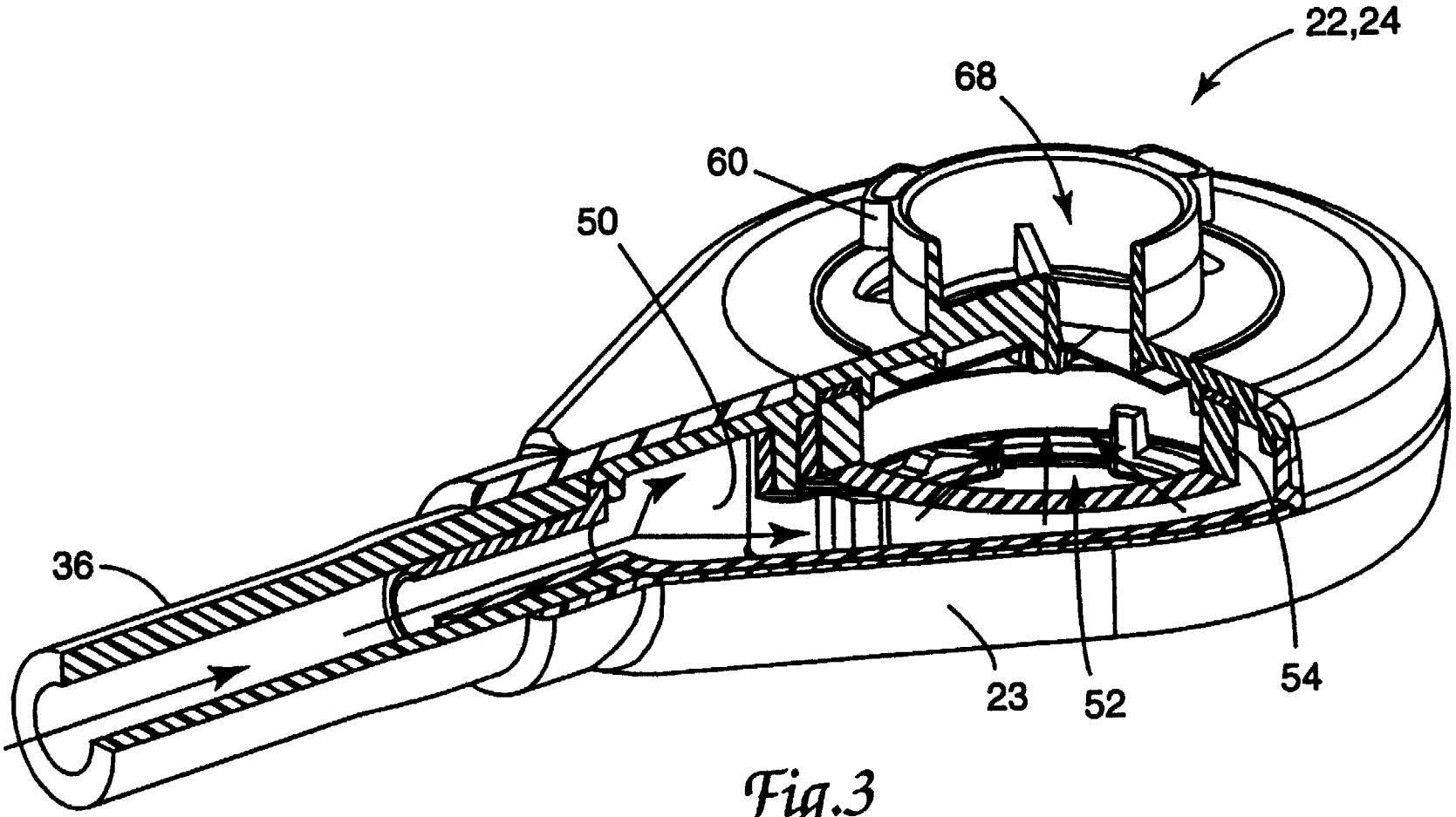
FIG. 3 is a cutaway perspective view of a positive/negative air pressure adaptor.

FIG. 3 is a sectional perspective view of the positive/negative air pressure adapters 22, 24 with arrows illustrating the flow of air from the air line 36 into an air distribution channel 50. In the embodiment illustrated in FIG. 3, the air distribution channel 50 extends generally around a port region 52, as will be discussed in detail below. However, it will be understood that a variety of air distribution chamber configurations may be utilized without departing from the scope of the present invention. A bayonet connector 60 is provided proximate an inhalation port 68 on an adaptor housing 23.

The supplied air illustrated by the arrows enters the air distribution channel 50 and passes radially through a porous member 54 into the port region 52. The porous member 54 may be constructed of a variety of porous materials such as sintered metal (for example brass), porous polypropylene or acetal, porous ceramic or glass bead structure, or a variety of other porous materials. A porous polyethylene with an average pore size of 100 microns manufactured by General Polymeric of Reading, Pa. is known to be suitable for this purpose.

Air Line Noise Attenuation Test

Respirator masks were tested for the amount of noise generated due to the air flow through the air line, adapter, valves, and facemask hardware system in a quiet laboratory setting with carpeting and acoustic ceiling treatment. The masks tested were fastened to a mannequin head and a microphone for sound pickup was positioned 3.5 cm from the head surface at a location corresponding to a representative ear. The sound generated by the air flow was acquired utilizing a microphone, preamplifier, and signal amplifier Model 2610 available from Bruel & Kjaer, Inc. (Naerum, Denmark) with "A" weighting of the signal. The signal was analyzed utilizing a Model 3561A Dynamic Signal Analyzer available form Hewlett Packard Co. (Everett, Wash.) set at the ⅓ octave mode with rms. (root mean square) averaging. The analysis bandwidth was the frequencies from 12.5 Hz to 20 Khz. The microphone, preamplifier, and amplifier were calibrated using a Model 4230 sound level calibrator available from Bruel & Kjaer, Inc. Half-mask respirator 3M Brand Easi-Air (TM) 7200 available from 3M Company of St. Paul, Minn. was tested at an air flow of 3.304 liters/second with both a 3M W3187 airline adapter and the instant invention adapter, with and without the muffler 54. Porous member 54 had an outside diameter of 4.0 cm, an inside diameter of 3.3 cm and a height of 1.1 cm. Sound pressure levels measured at the microphone are listed in Table 1.

TABLE 1

| Respirator Construction | Sound Pressure level Measurements 250 Hz (dB) | 500 Hz (dB) | 1 KHz (dB) | 2 KHz (dB) | 4 Khz (dB) | 10 Khz (dB) | 20 Khz (dB) | Integrated Sound Pressure level (dB) |
|---|---|---|---|---|---|---|---|---|
| 7200 Half Mask with W-3187 adapter | 56 | 62 | 66 | 89 | 85 | 85 | 74 | 94.5 |
| 7200 Half Mask with inventive adapter without muffler | 39 | 54 | 64 | 71 | 73 | 98 | 65 | 99.7 |
| 7200 Half Mask with inventive adapter with muffler | 39 | 44 | 51 | 63 | 67 | 61 | 51 | 73.5 |

These results demonstrate that the muffler provides a typical 20 dB reduction of the integrated sound pressure level over the frequency range of 12.5 Hz through 20 kHz. This corresponds to a noise level of one quarter the amount present with adapters without the muffler material. In addition, the porous member 54 acts as a diffuser to dissipate the intensity of the air flow, reducing the maximum velocity of the air entering the face mask 26, while providing a continuous flow of supplied air in excess of the user's requirements.

Figure 4:
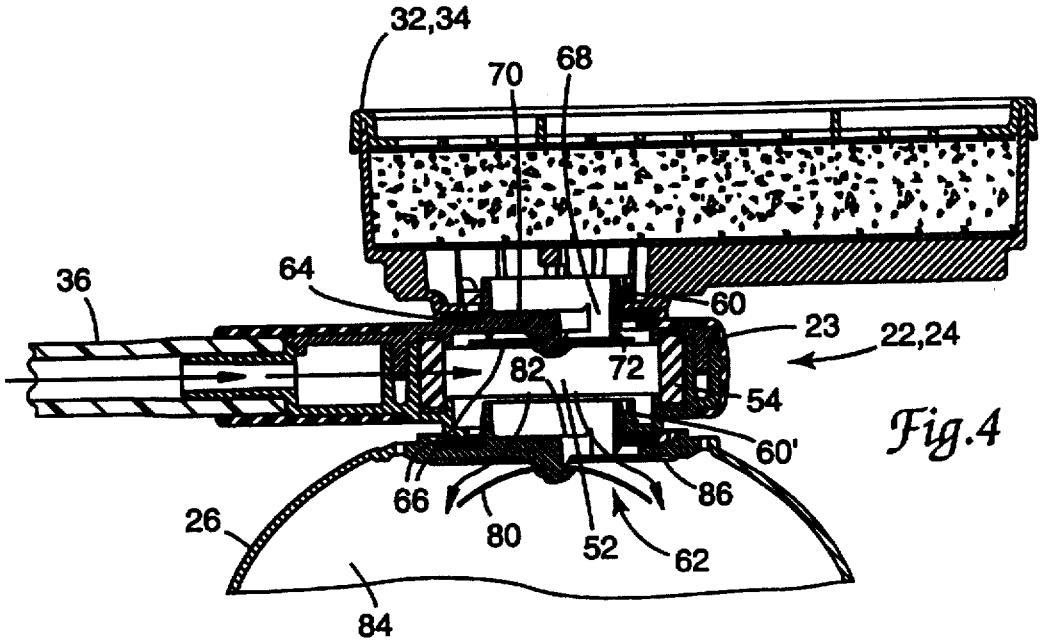
FIG. 4 is a side sectional view of a respirator system with a positive/negative air pressure adaptor connected to a positive pressure air source.

FIG. 4 is a side sectional view of a positive/negative air pressure adaptor 22 or 24 fluidically coupling a filter cartridge 32 or 34 to a single inhalation port 62 on the face mask 26. The filter cartridge 32 or 34 is attached by the bayonet connector 60 at the inhalation port 68 on the adaptor 22 or 24 (see also FIG. 3). A corresponding bayonet connector 60' is also provided proximate the inhalation port 62 on the face mask 26. In the preferred embodiment, the bayonet connectors 60, 60' are identical so that a filter cartridge 32, 34 may be attached directly to the face mask 26. However, it will be understood that for some applications it may be desirable to alter one of the bayonet connectors 60, 60' to limit the type of components that may be attached thereto. Seals 64, 66 preferably are interposed between the adapters 22, 24 and the filter cartridge 32, 34 and face mask 26. The seals may be constructed of a variety of resilient materials, such as closed cell urethane rubber or silicone may be suitable for this purpose.

Although the preferred embodiment discloses bayonet connectors 60, 60', it will be understood that the present invention is not limited to the type of connector used to fluidically couple the various components 22, 24, 26, 32, 34. Other types of connectors uniquely adapted to receive a threaded member which is adapted to thread into a corresponding integral cylinder sealed with or without a gasket, both permanent and detachable, may be combined without departing from the scope of the present invention. Additionally, some of the components may be constructed as a single unit. For example, the filter cartridge 32, 34 and the adaptor 22, 24 may be a single unit. Alternatively, the inhalation port 62 on the face mask 26 and the adapters 22, 24 may be constructed as a single unit.

As illustrated in FIG. 4, once the air passes the porous member 54 and enters into the port region 52, a positive pressure valve 66 restricts air from passing through the inhalation port 68 and into the filter cartridges 32, 34. The positive pressure valve 66 is attached to a support 70 which extends generally into the opening formed at the inhalation port 68. The pressure of the air forces the positive pressure valve 66 against a valve seat 72 on the adaptor housing 23 and enhances the seal of the valve. In the event that the positive pressure air source 38 does not provide adaquate air flow for the user's need, the inhalation of the user will create a net negative pressure in the face mask chamber 84. The net negative pressure draws the valve 66 off of the valve seat 72 and allows air to be drawn through the cartridge 32, 34. In the embodiment disclosed in FIG. 4, the positive pressure valve 66 is a diaphragm valve constructed from a highly flexible material such as silicone rubber. It will be understood that a variety of check valve configurations may be suitable for this purpose and that the present invention is not limited by the particular type of check valve disclosed.

An inhalation valve 80 located across an opening 82 proximate the inhalation port 62 permits the air in the port region 52 to enter a face mask chamber 84 defined by the face mask 26 and the face of the user (not shown). The inhalation valve 82 may also be constructed of a highly flexible material such as silicone rubber. It will be understood that the inhalation valve 80 may alternatively be located on the adaptor housing 23. The net positive pressure in the face mask chamber 84 during exhalation by the user forces the inhalation valve 80 against a valve seat 86. The excess pressure in the face mask chamber 84 is released through the exhaust port 28 (see FIG. 1).

Figure 5:
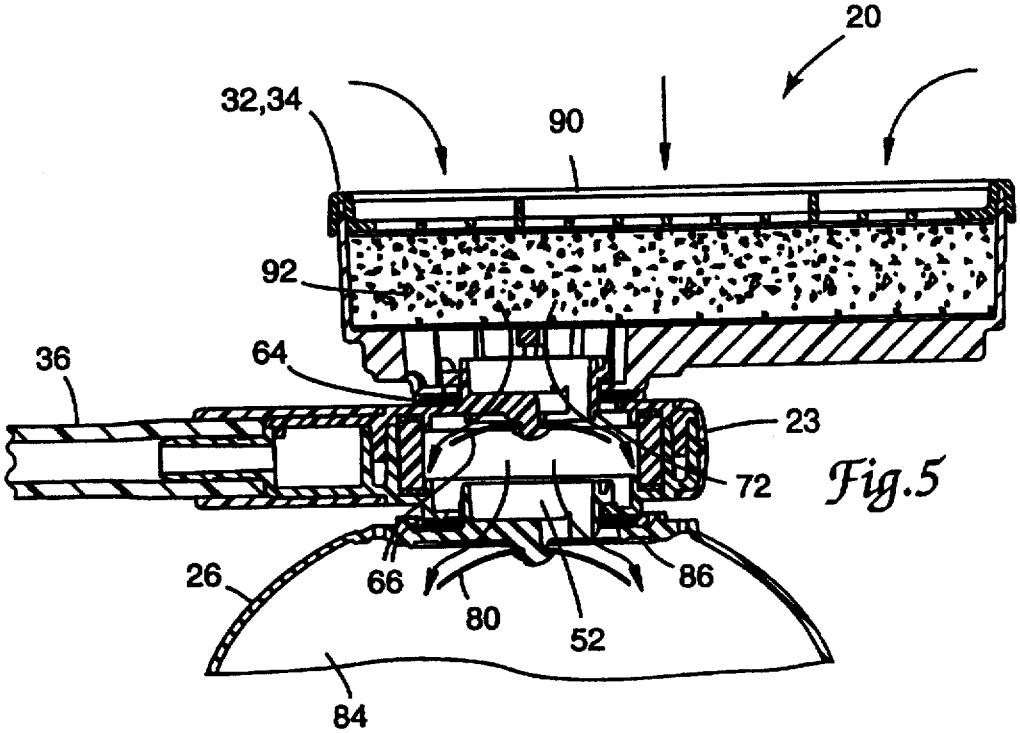
FIG. 5 is the respirator system of FIG. 4 in which the positive pressure air source has been terminated or reduced.

The positive pressure air source 38 may be reduced or terminated for a variety of reasons. For example, malfunction of a compressor, accidental kink or cut of the air line 36, or the user's intentional disconnect of the air line 36 to provide greater mobility. The arrows in FIG. 5 illustrate the air flow through the respirator system 20 if the positive pressure air source 38 is reduced below the user's requirements or terminated. The lack of positive pressure in the port region 52 permits the positive pressure valve 66 to be lifted from its valve seat 72 to allow air flow through the filter cartridge 32, 34. In the configuration illustrated in FIG. 5, the respirator system 20 is operating as a negative pressure system which relies on the user's lung power to draw air through openings 90 in the filter cartridge 32, 34, through the filter media 92 and into the face mask chamber 84. As discussed in connection with FIG. 4, the inhalation valve 80 is forced against its valve seat 86 when the user exhales so that the excess pressure in the face mask chamber 84 is expelled through the exhaust port 28 (see FIG. 1).

In the event the user disconnects the air line 36 from the positive pressure air source 38, the check valve 40 in the air line 36 prevents contaminated air from being drawn up the air line when the respirator system 20 is operating in the negative pressure mode. In the embodiment disclosed in FIG. 1, the check valve 40 is located proximate a quick release mechanism 42 that permits the user to disconnect the respirator system 20 from the positive air source 38.

Figure 6A:
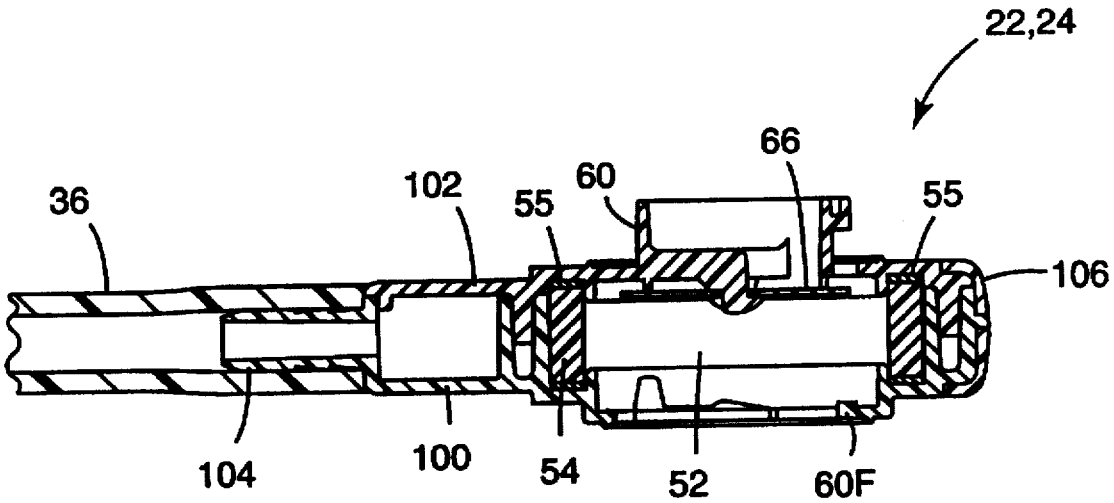
FIGS. 6A and 6B are side sectional views of a positive/negative air pressure adaptor before and after overmolding, respectively.
Figure 6B:
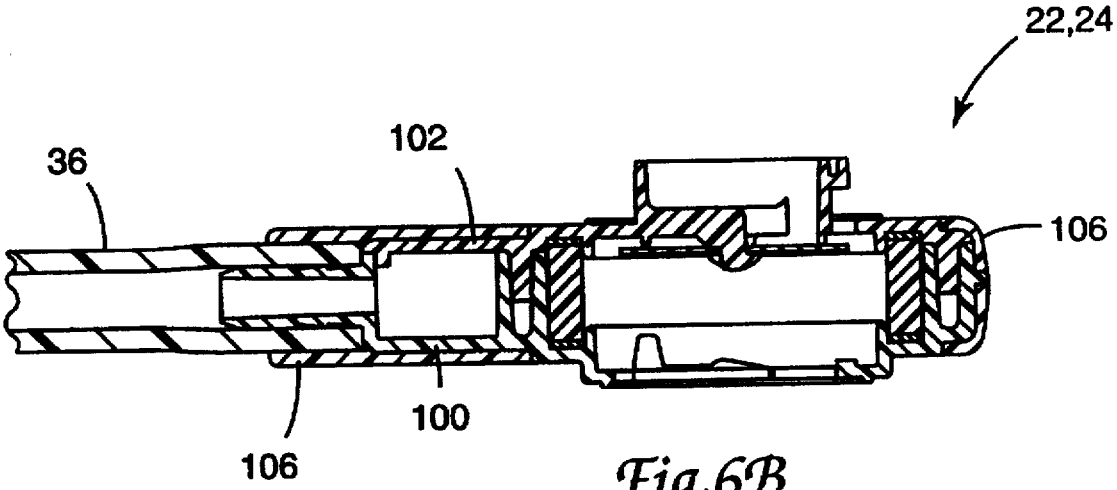

FIGS. 6A and 6B illustrate an exemplary method of manufacturing the positive/negative air pressure adapters 22, 24. The primary components of the adaptor are a base 100, a cover 102, the porous member 54, and gaskets 55. The base 100 has a female bayonet connector 60F for engagement with the bayonet connector 60' on the face mask 26. The base 100 also has a barbed connector 104 with a ferule or some acceptable fastening mechanism for retaining the air line 36. A strain relief spring and retaining clip may be added to retain the air line 36 to the barbed connector 104. The base 100 and cover 102 may be constructed from a variety of polymeric materials, such as polyethylene, polypropylene, polystyrene. Polypropylene 6323 available from Himont of Minneapolis, Minn. has been found suitable for this purpose.

The air line 36 generally has a 6 mm inner diameter which corresponds to the outside diameter of the barbed connector 104, although air lines with 3 mm inner diameters may also be suitable for some purposes. For applications utilizing a portable powered-air purifying respirator, an air lines having a 25 mm bore size is generally required. The outside diameter of the barbed connector 104 may be manufactured to accommodate any size air line. Tubing constructed from a 50/50 blend of Shell Kraton G2701 and G2705 available from Shell Chemical Company of Houston, Tex. may be used for this purpose.

FIG. 6B illustrates an exemplary method for attaching the air line 36 to the connector 104, and creating a hermetic seal between the base 100 and cover 102. The adaptor housing 23 attached to the air line 36 are placed into a mold where it is overmolded with a polymeric material 106. Although a variety of polymeric materials 104 may be used for this purpose, it has been found that the compatibility of certain polymeric materials result in a chemical bond which provides ideal mechanical strength and hermetic sealing. For example, a polymeric material sold under the trade name Monprene 2850M, available from Quality Service Technology of St. Albans, Vt., Kraton identified above or polypropylene are particularly compatible with a base and cover 100, 102 constructed from polypropylene and an air line 36 constructed from Kraton or Monoprene.

Figure 7A:
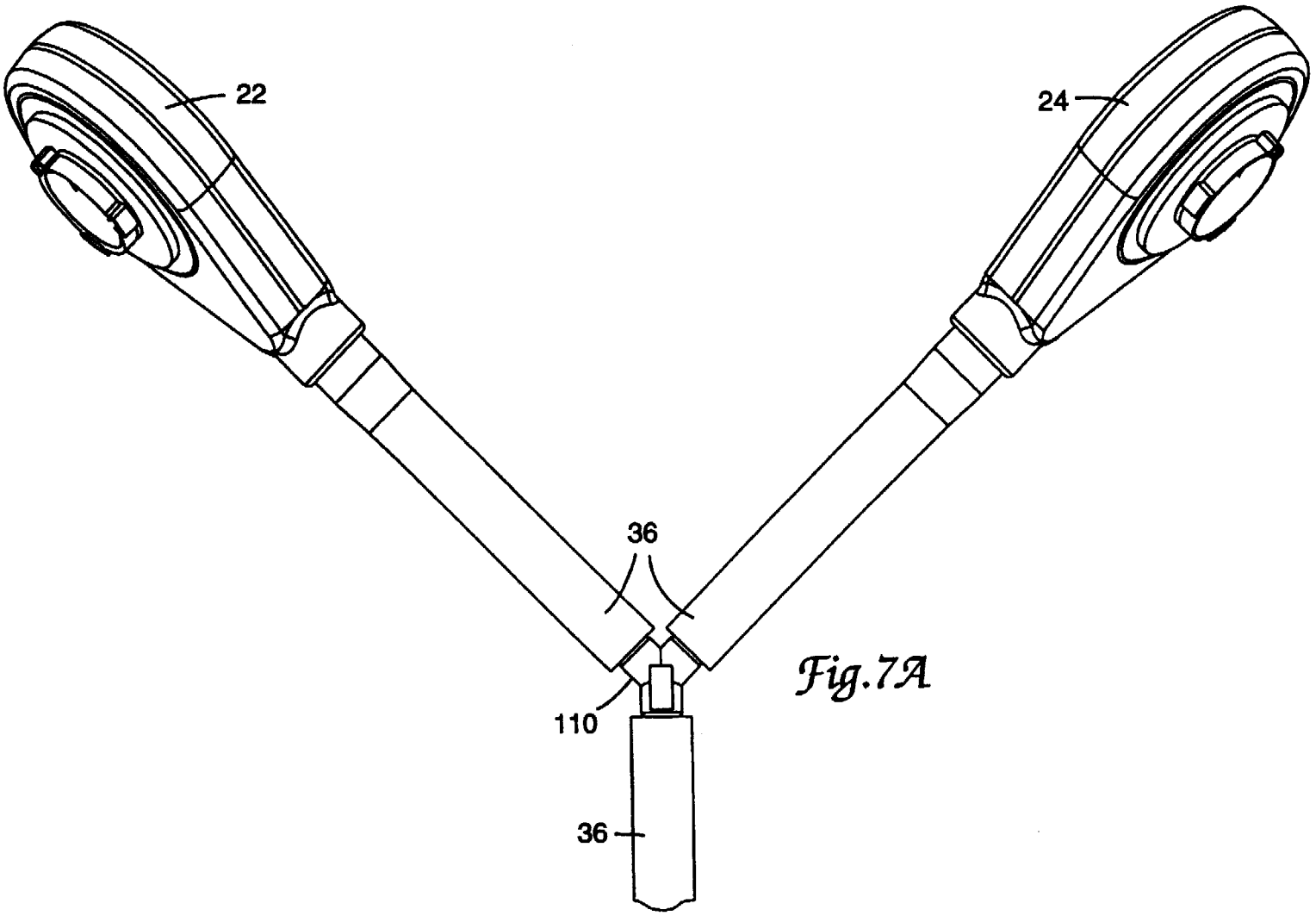
FIGS. 7A and 7B are perspective views of a Y-fitting for the present positive/negative air pressure adaptor system before and after overmolding, respectively.
Figure 7B:
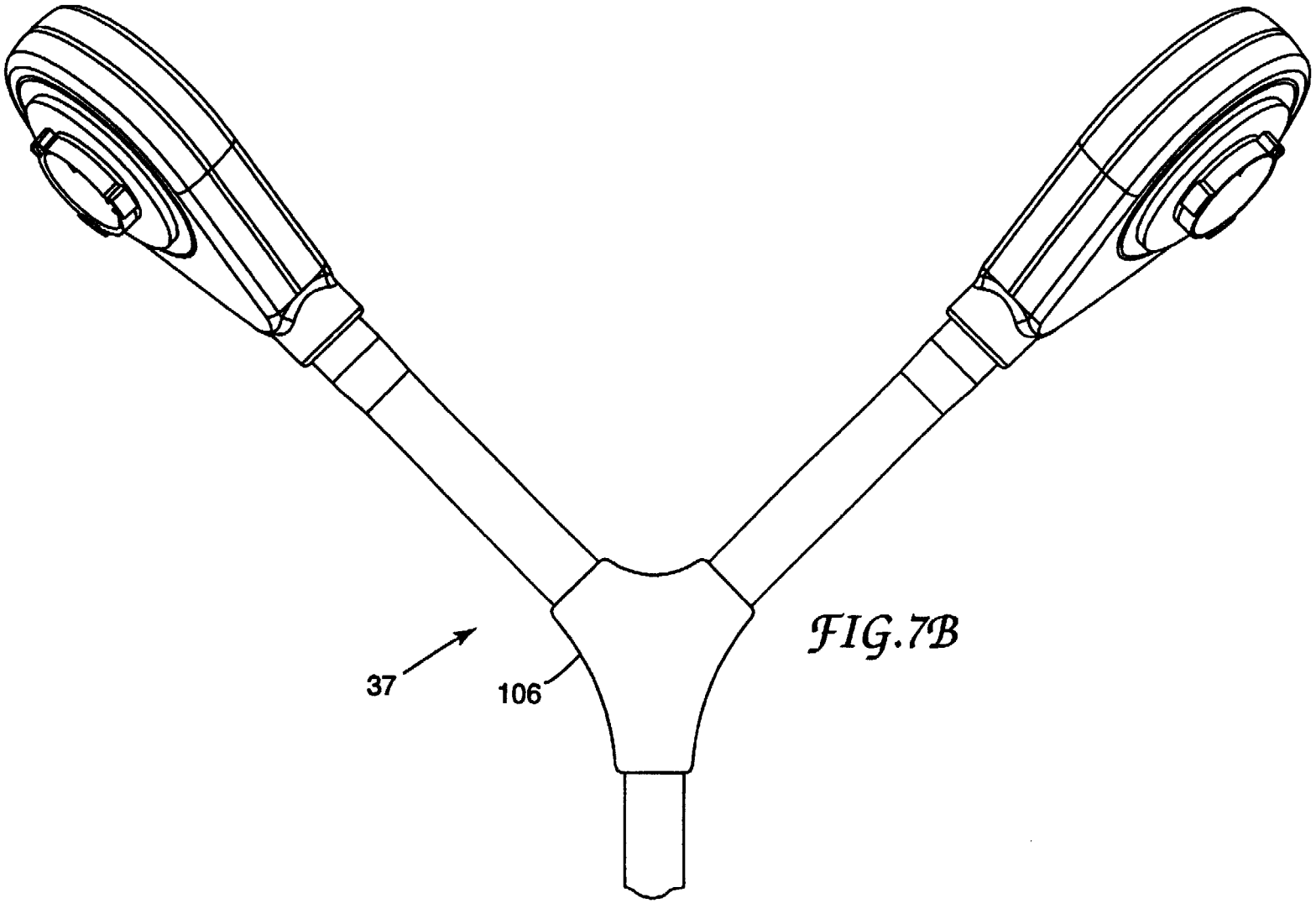

FIGS. 7A and 7B illustrate use of the present overmolding technique to form a Y-connector 37 for connection to a pair of adapters 22, 24. A Y-fitting 110 is attached to three sections of air line 36. The Y-fitting 110 and air lines 36 are then overmolded as illustrated in FIG. 7B using the materials 106 discussed above.

Figure 8:
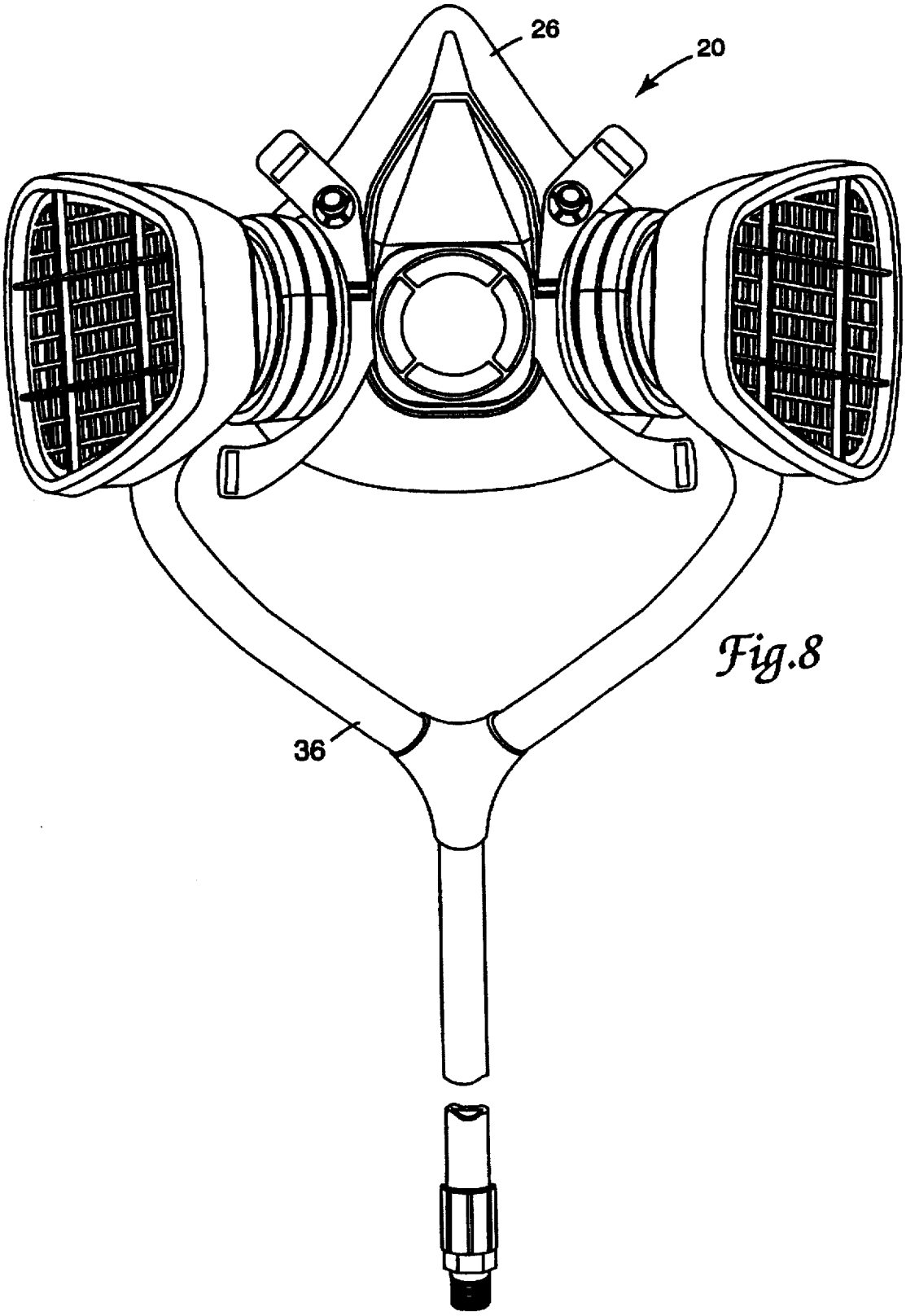
FIG. 8 is an alternate configuration of the respirator system of FIG. 1.
Figure 9:
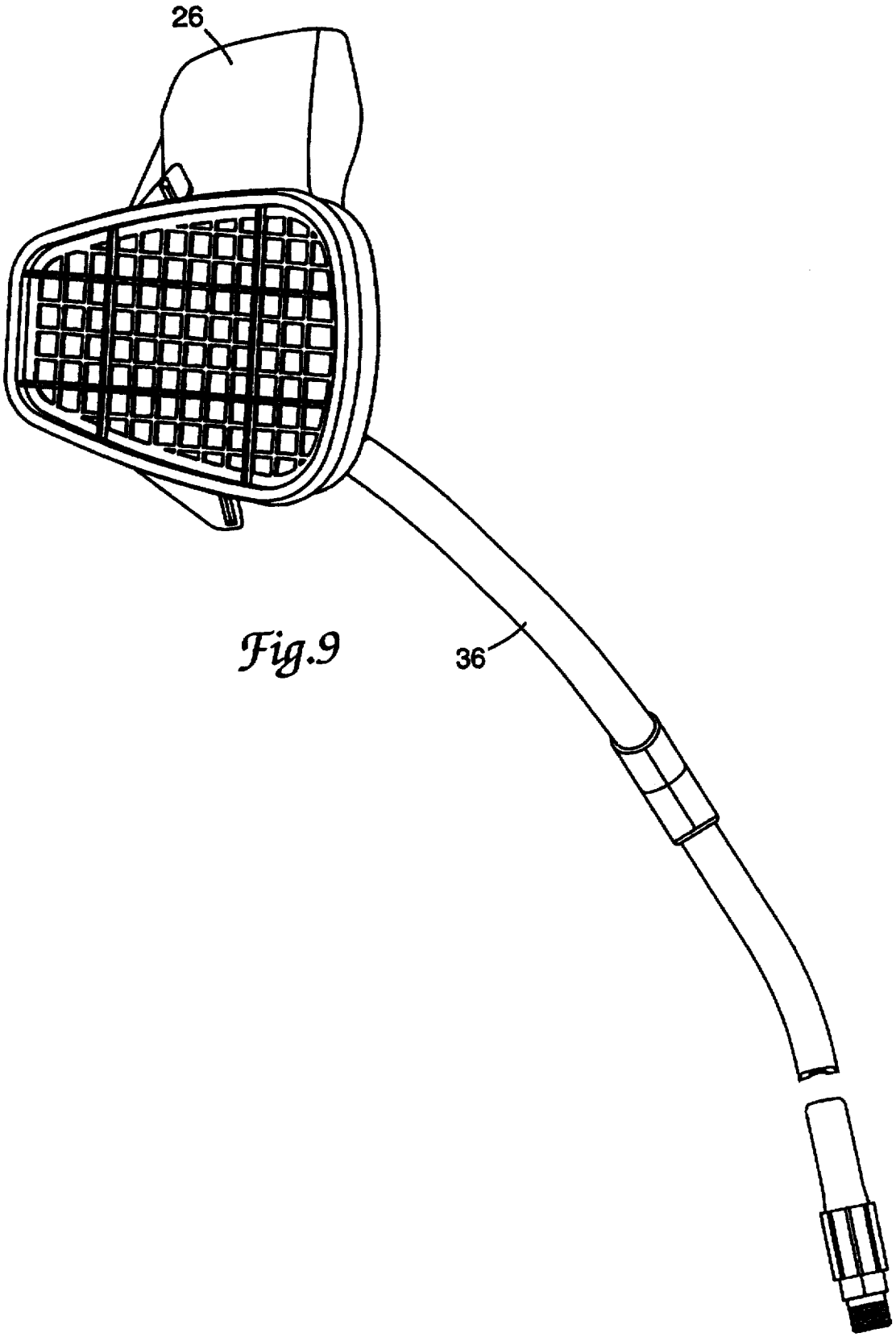
FIG. 9 is a side view of the respirator system of FIG. 8.

FIGS. 8 and 9 illustrate an alternate embodiment of the respirator system 20 in which the air lines 36 are configured to extend towards the rear of the face mask 26. As illustrated in FIG. 9, the air line 36 extends towards the rear of the user so as to not interfere with the user's activities.

Figure 10:
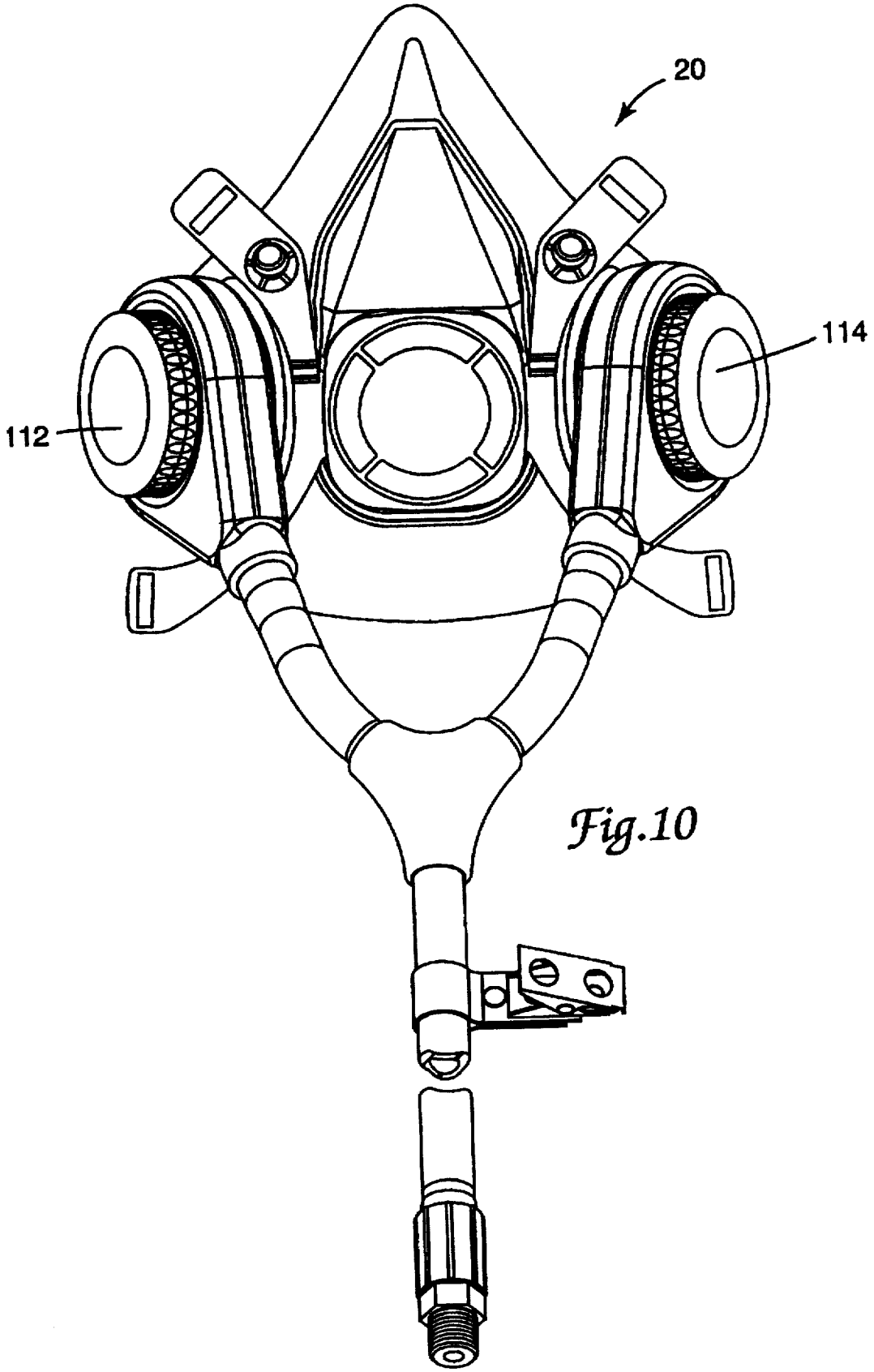
FIG. 10 is an alternate embodiment of the respirator of FIG. I with the filter cartridges removed.

FIG. 10 is another alternate embodiment of the respirator system 20 in which the filter cartridges 32, 34 have been removed, and valve caps 112, 114 have been substituted. In the configuration illustrated in FIG. 10, the respirator system 20 operates only as a positive pressure respirator system generally corresponding to FIG. 1.

Figure 11:
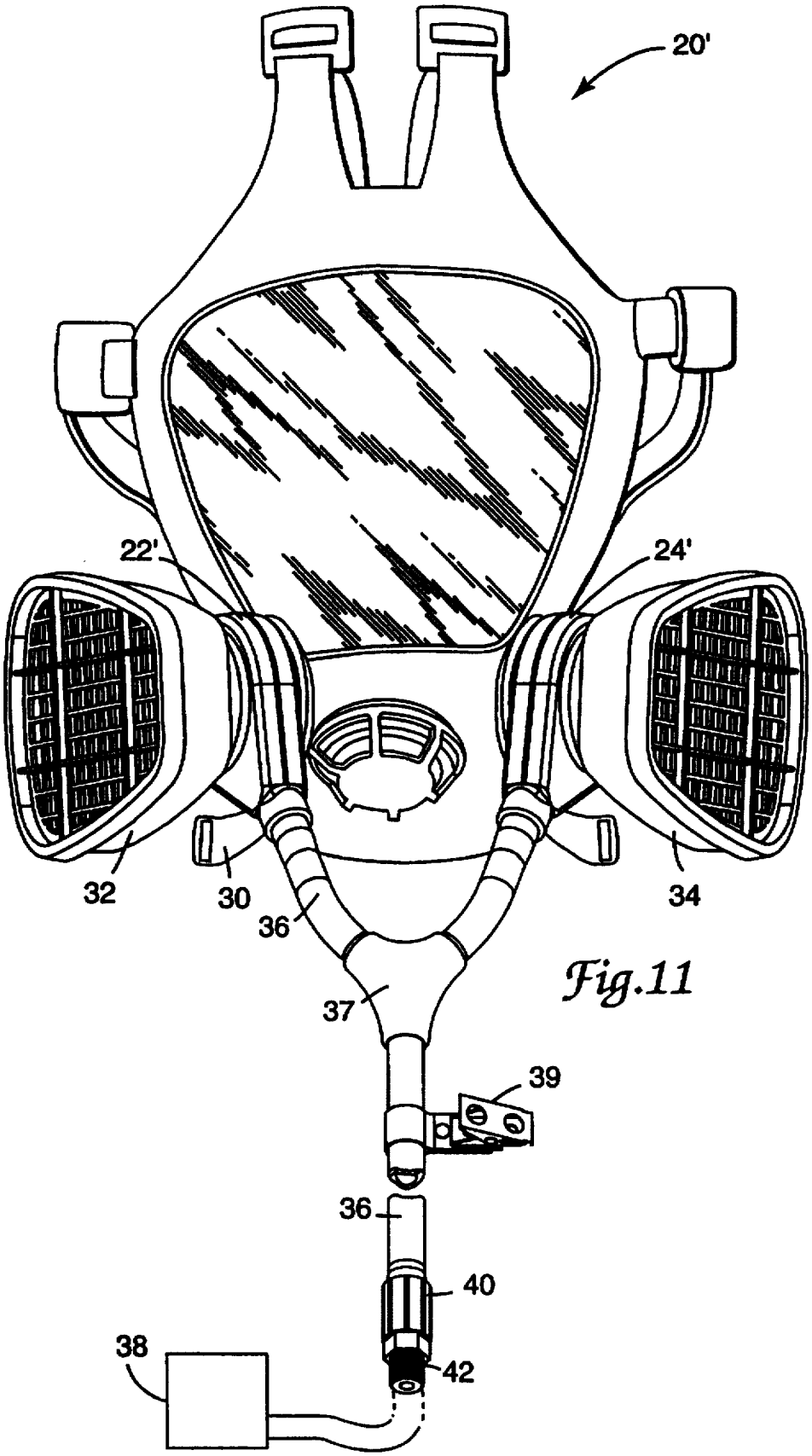
FIG. 11 is an alternate full face mask respirator system with a positive/negative air pressure adaptor connected to a positive pressure air source.

FIG. 11 is an alternate full face mask respirator system 20' with a pair of positive/negative air pressure adapters 22', 24'connected to a positive pressure air source 38. The full face mask 20' typically encloses the mouth, nose and eyes of the user.

It will be understood that the exemplary embodiments in no way limit the scope of the invention. Other modifications of the invention will be apparent to those skilled in the art in view of the foregoing descriptions. These descriptions are intended to provide specific examples of embodiments which clearly disclose the invention. Accordingly, the invention is not limited to the described embodiments or to the use of specific elements, dimensions, materials or configurations contained therein. All alternative modifications and variations of the present invention which fall within the spirit and broad scope of the appended claims are covered.

What is claimed is:

1. An air pressure adaptor for fluidly coupling a positive pressure air source to a portable respirator worn by a user, the air pressure adaptor comprising:

an adaptor housing directly connectable to the respirator, the adaptor housing having an inlet port fluidly coupled to a port region within the adaptor housing, the inlet port connectable to the positive pressure air source and the port region fluidly connectable to the respirator; and a porous structure interposed between the inlet port and the port region, whereby the porous structure capable of permitting compressed air to flow from the inlet port to the port region while attenuating air line noise.

2. The apparatus of claim 1 wherein the porous structure is selected from a group consisting of sintered metal, porous polypropylene, porous polyethylene, porous acetal, porous ceramic or a porous glass bead structure.

3. The apparatus of claim 1 wherein the porous structure is capable of directing compressed air from the positive pressure air source radially into the port region.

4. A portable respirator system worn by a user for use with a positive pressure air source, the respirator system comprising:

a face mask having an exhaust port and at least one inhalation port;

an adaptor housing fluidly connectable to the at least one inhalation port, the adaptor housing having an inlet port fluidly coupled to a port region within the adaptor housing, the inlet port connectable to the positive pressure air source and the port region fluidly connectable to the face mask; and a porous structure interposed between the inlet port and the port region, whereby the porous structure capable of permitting compressed air to flow from the inlet. port to the port region while attenuating air line noise.

5. The apparatus of claim 4 wherein the porous structure is selected from a group consisting of sintered metal, porous polypropylene, porous polyethylene, porous acetal, porous ceramic or a porous glass bead structure.

6. The apparatus of claim 4 wherein the porous structure is capable of directing compressed air from the positive pressure air source radially into the port region.

* * * * *